US008823714B1

(12) United States Patent
Thielvoldt et al.

(10) Patent No.: US 8,823,714 B1
(45) Date of Patent: Sep. 2, 2014

(54) MUSIC-REACTIVE FIRE DISPLAY

(75) Inventors: Mike Thielvoldt, Berkeley, CA (US); Brett Levine, San Francisco, CA (US)

(73) Assignee: Livespark LLC, San Francisco, CA (US)

( * ) Notice: Subject to any disclaimer, the term of this patent is extended or adjusted under 35 U.S.C. 154(b) by 783 days.

(21) Appl. No.: 12/710,332

(22) Filed: Feb. 22, 2010

Related U.S. Application Data

(60) Provisional application No. 61/154,723, filed on Feb. 23, 2009.

(51) Int. Cl.
*F24C 3/00* (2006.01)
*G10L 11/00* (2006.01)

(52) U.S. Cl.
USPC ..... 345/473; 431/125; 431/12; 431/2; 431/89; 126/512; 126/500; 704/200; 704/231

(58) Field of Classification Search
None
See application file for complete search history.

(56) References Cited

U.S. PATENT DOCUMENTS

| | | | | |
|---|---|---|---|---|
| 4,394,121 | A * | 7/1983 | Wakamiya et al. | 432/11 |
| 4,694,498 | A * | 9/1987 | Suzuki et al. | 381/103 |
| 4,766,921 | A * | 8/1988 | Williams | 137/1 |
| 5,450,841 | A * | 9/1995 | Whitaker et al. | 126/512 |
| 5,538,690 | A * | 7/1996 | Greer et al. | 422/86 |
| 5,890,485 | A | 4/1999 | Shimek et al. | |
| 6,162,045 | A * | 12/2000 | Hazard | 431/1 |
| 6,413,079 | B1 | 7/2002 | Lyons et al. | |
| 6,602,068 | B2 * | 8/2003 | Atemboski et al. | 431/125 |
| 6,607,499 | B1 * | 8/2003 | Becher | 601/133 |
| 7,229,278 | B1 * | 6/2007 | Newberry | 431/79 |
| 2002/0023020 | A1 * | 2/2002 | Kenyon et al. | 705/26 |
| 2002/0086255 | A1 * | 7/2002 | Chen | 431/51 |
| 2004/0075070 | A1 * | 4/2004 | Munsterhuis | 251/30.02 |
| 2005/0126373 | A1 * | 6/2005 | Ludwig | 84/661 |
| 2005/0208443 | A1 * | 9/2005 | Bachinski et al. | 431/8 |
| 2006/0151113 | A1 * | 7/2006 | Ahn | 156/345.26 |
| 2007/0230494 | A1 * | 10/2007 | Nakayama | 370/412 |
| 2008/0314228 | A1 * | 12/2008 | Dreyfuss et al. | 84/477 R |
| 2009/0190327 | A1 * | 7/2009 | Adenau | 362/85 |
| 2009/0325114 | A1 * | 12/2009 | Noman | 431/354 |

FOREIGN PATENT DOCUMENTS

| | | | | |
|---|---|---|---|---|
| EP | 408846 | A1 * | 1/1991 | F23D 14/60 |

OTHER PUBLICATIONS

Le Letty, R., et al. "Valves based on amplified piezoelectric actuators." online,[retrieved on Jun. 20, 2011]. Retrieved from the Internet: http://www. cedrat. com/fileadmin/user—upload/cedrat—groupe/Publications/Publications/2002/06/Actuator2002—A4-6—VALVES-BASED-ON-AMPLIFIED-PIEZOELECTRIC-ACTUATORS. pdf (2002).*

Situm, Zeljko, T. Zilic, and Mario Essert. "High speed solenoid valves in pneumatic servo applications." Control & Automation, 2007. MED'07. Mediterranean Conference on. IEEE, 2007.*

Sorli, Massimo, Giorgio Figliolini, and Stefano Pastorelli. "Dynamic model and experimental investigation of a pneumatic proportional pressure valve." Mechatronics, IEEE/ASME Transactions on 9.1 (2004): 78-86.*

* cited by examiner

*Primary Examiner* — Ulka Chauhan
*Assistant Examiner* — Sultana M Zalalee
(74) *Attorney, Agent, or Firm* — Wilson Sonsini Goodrich & Rosati

(57) ABSTRACT

The invention provides a system for controlling flame to produce a music-reactive fire display. This system comprises a digital signal analyzer, electronically-controlled burner elements that allow variable control of fuel flow rate, an automatic ignition system, flame detection, and a means of communication between the signal analyzer and the burner elements.

39 Claims, 10 Drawing Sheets

MUSIC-REACTIVE FIRE DISPLAY

CROSS-REFERENCE

This application claims the benefit of U.S. Provisional Application No. 61/154,723, filed Feb. 23, 2009, which application is incorporated herein by reference.

FIELD OF THE INVENTION

The invention relates generally to digital visualization devices and, more specifically, to a device which controls fuel, such as gas, used in combustion to produce a music-reactive fire display.

BACKGROUND OF THE INVENTION

There are a number of known systems that modulate light in response to audio signals. These typically incorporate an electronic audio signal processing unit, which, in some systems, is a computer running audio analysis software and in other systems is a piece of dedicated hardware, either digital or analog. This unit converts the audio signal into representative visual signals, which drive a plurality of lights. These systems create a sensory experience that combines cohesive auditory and visual stimulation.

Fire is often used decoratively in fireplaces and in theatrical fire effects for its unique and powerful sensory impact. See, e.g., U.S. Pat. No. 5,890,485 and U.S. Pat. No. 6,413,079, which are hereby incorporated by reference in their entirety. In theatrical effects, bursts of fire are sometimes triggered in conjunction with music as in the FlameProj system used by Maya Effects. The Maya Effects system is an electrically triggered flame element which has two states: on and off. Theatrical fire effects operate on a pre-recorded sequence of timed triggers, and lack a signal analyzer that converts an input stream into burner control signals in real-time. Additionally, these systems lack variable control of the flame intensity, which limits the flames to burst-and-hold events of the same intensity but varying duration. This greatly reduces the variety of visual effects that the flame display can generate.

Accordingly, a need exists for improved visualization effects where flame is modulated in response to electronic input signals in real-time. A further need exists for a digitally-controlled music-reactive fire display that combines the sensory stimuli of fire with music, or another streaming input in a cohesive, aesthetic modality.

SUMMARY OF THE INVENTION

The invention provides systems and methods for displaying digitally controlled fire. Various aspects of the invention described herein may be applied to any of the particular applications set forth below or for any other types of music-reactive displays or digitally controlled flame displays. The invention may be applied as a standalone system or method, or as part of an integrated display package, such as a fireplace, a theatrical fire display, or any other fire display. It shall be understood that different aspects of the invention can be appreciated individually, collectively, or in combination with each other.

The invention provides a digitally controlled fire display, which may comprise an electronic signal analyzer that may convert an electronic input signal (such as an audio signal, musical signal), into electronic control signals as it receives the input signal, variable electronically-controlled gas valves, an automatic ignition system for lighting the combustible gas, a flame detection system, and a communication system between the signal analyzer and the valves. This system may allow a far more flexible digitally controlled fire display than known fire effect systems owing to the variable gas control and signal analysis.

In one embodiment of the invention, the electronic signal analyzer may be a computer, or any device that includes a processor, that runs audio analysis software. In other embodiments, the signal analyzer may be a computer that receives packets of digital information from a network, or receives information from a peripheral device, or processes an output stream from a software application, and modulates the flames in response to the information it receives.

Preferably, the components of this invention other than the signal analyzer may be built into individual flame elements, which may include a variable valve, an ignition system and flame detection system. These flame elements may communicate with the signal analyzer via a serial protocol. In alternative embodiments of this invention, the components could be organized differently. For instance, there could be one ignition system instead of several, several redundant flame detection systems, or a distributed signal analyses system. In some instances, one signal analyzer may be provided for the fire display system, while in other embodiments, multiple signal analyzers may be provided, or may be distributed over the fire display system. Any number of these fire display system may be provided, and they may have any relation, e.g., one to one, one to many, many to one, for each part.

Preferably, the systems in each flame element may be operated by a digital microcontroller which can send analog control signals to the variable valve, activate the ignition system to light the flame, monitor the flame detection system, and interpret the control signals from the signal analyzer. Alternatively, each of these systems might operate independently of any microcontroller. For instance, the flame detection system could operate its own gas shut-off valve if it detects that the flame has failed to ignite.

In a preferable embodiment of this invention, the variable gas valve may be a proportional solenoid valve (PV). The PV can be actuated by varying the current supplied to the solenoid coil. This may be accomplished by driving the coil with a transistor using pulse-width modulation (PWM) from the microcontroller. A low-pass filter may be connected between the transistor and the solenoid coil to smooth the power transfer to the coil.

Manufacturing limitations, hysteresis, and thermal drift are all factors that may cause the flow rate of gas to vary over time or from valve to valve with respect to a known valve input signal. In order to achieve a perceptually uniform flame pattern across several burners, precise control of the flow rate may be necessary. To compensate for flow rate discrepancies, the preferred embodiment of this invention may include a calibration routine that can continually adjust the control signal to the valve to maintain a desired flow rate. In a preferable embodiment, this calibration routine may utilize the flame detection circuitry as a reference for achieving the desired flow rate. In an alternate embodiment, another device may be used to measure the flow rate through the valve, and that could inform a feedback loop or calibration routine. Alternatively, either the valve or the controlling electronics may incorporate passive systems that counteract sources of flow rate variation.

In a preferable embodiment, a high-voltage spark may be used as the ignition system. The spark can be generated by applying a pulsating current to a first transformer to generate an intermediate high-voltage, e.g., 500 volts. This transformer may feed a rectifier, and charge-storage capacitor, where the voltage accumulates. This capacitor may be connected to the primary windings of a second transformer through an electrically-triggered switch such as a silicon controlled rectifier (SCR). When the microcontroller triggers the SCR, the charge-storage capacitor may be discharged through the primary winding of the second transformer. This discharge can create a very high voltage across the secondary winding of the second transformer, e.g. 50,000 volts. The second windings of the transformer may be connected to the igniter; the high voltage can cause arcing at the igniter, which may ignite the flammable gas. Alternatively, a different ignition system could be used, such as a hot-surface igniter.

The flame detection system of the invention may insure that, in the event of a failure to ignite, flammable gas will not accumulate and cause a hazardous condition. In a preferable embodiment of the invention, the flame detection system may utilize the conductivity of a flame to detect the presence or absence of a flame. The flame detection may detect the presence or absence of the flame using the same electrodes as the igniter. This may be accomplished by applying a voltage across the igniter electrodes and detecting the presence or absence of an induced current. Because the same electrodes can be used for igniting the flame as detecting the flame, precautions may be taken to prevent the high sparking voltage from damaging the flame detection circuitry. These precautions are discussed in the detailed description of this system. An alternative to using a detection system based on flame conductivity may be to use a thermocouple, thermopile, a system based on flame rectification, or a redundant combination of more than one of these techniques to implement flame detection.

In a preferable embodiment of the invention, a custom serial protocol, RS-232 compliant hardware, and the aforementioned microcontrollers may be used as the means of communication between the signal analyzer and the gas valves. To facilitate communication of one signal analyzer with multiple flame elements using a signal analyzer with only one serial port, the flame elements may be connected in series. Only one element may receive data directly from the computer. The microcontroller on that element may transmit the data it receives from the computer to the next element, and so-on. The protocol may allow the computer to send commands to individual elements. All of the elements may receive the command, but only the element with the specified address executes the command.

In alternative embodiments, the communication between the signal analyzer and the valves could be accomplished by many different electronic means. For example, the signal analyzer might have several analog-output channels and vary the current to each valve directly. Alternatively, linear transducers could be employed between the signal analyzer and the valves. The signal analyzer may also have one or more analog-output channels, and may vary the current to a series of flame elements, or flame elements arranged in parallel, or flame elements arranged in any combination thereof.

Another aspect of the invention may be directed to a method for controlling fire to produce visual effects in flames. Such a method may include conveying an electric input stream representing music or any other audio stream to a signal analyzer. The method may also include deriving, using a signal analyzer, several digital streams representing visualizations to several perceptual elements in an audio stream, adjusting the amplitudes of at least one of the digital visualization streams at the signal analyzer to form adjusted visualization streams, and combining the digital and/or adjusted visualization streams into a single combined visualization output stream. The method may also include modulating a plurality of variable gas valves that may control the flow of gaseous fuel in response to the combined visualization output stream, and conveying the gaseous fuel modulated by the variable valves to the plurality of burners to produce flames that vary in reliance on the music represented by the audio stream.

Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the invention will be obtained by reference to the following detailed description that sets forth illustrative embodiments, in which the principles of the invention are utilized, and the accompanying drawings of which:

DETAILED DESCRIPTION OF THE INVENTION

While preferred embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

Figure 1:
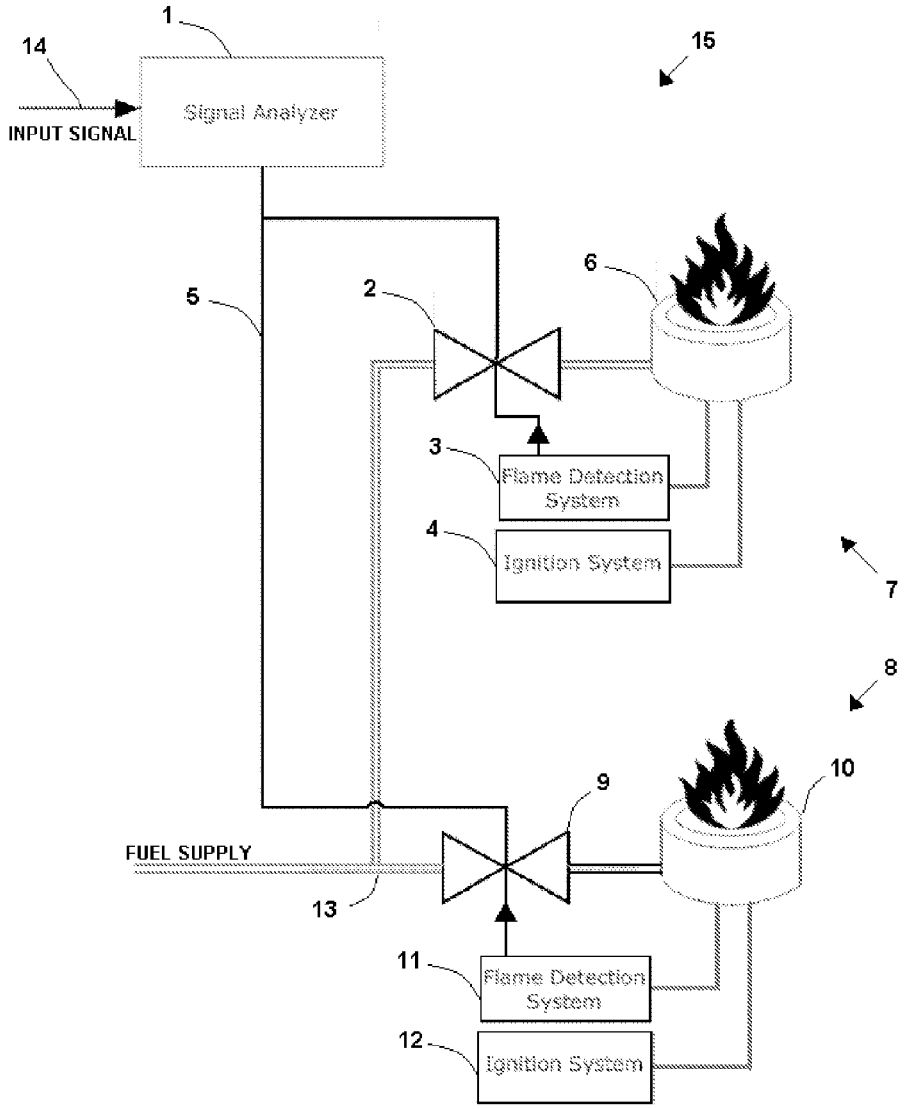
FIG. 1 is a schematic diagram of a preferable embodiment of a music-reactive fire display showing principal elements in a preferable arrangement.

FIG. 1 schematically illustrates a preferable arrangement of the fire display 15. The input signal 14 enters the signal analyzer 1 to be converted into an output signal which may control the variable valves 2 and 9 via a communication system or component 5. Such steps may occur in real time. For example, as an input stream is entering the signal analyzer, the signal analyzer may provide the output signal based on the input signal, and the variable valves may be controlled as the output signal is received. The variable valves may be controlled as the input stream is provided in an ongoing manner. Thus, variable valves may be controlled before an input stream is completed, and in real-time reliance on the input stream.

The input signal may be a digital input stream. In some embodiments, the input stream may be an audio stream or may be based on or derived from an audio stream, which may include a musical input. A musical input may include instrumental musical input, voice musical input, synthesized musical input, or any combination thereof. Any other input signal may be provided, including but not limited to, input signals generated by a computer or other device, such as a mobile device (e.g., phone, smart phone, iPhone, Blackberry, personal digital assistant—PDA). In some instances, the input signals may be generated on a computer or other device in response to an audio signal, or other event that may occur on the computer (e.g., input from a user via a web browser or other graphical user interface, receiving an email, etc.).

Some examples of input sources, e.g., for music, may include an audio input jack for a line carrying an analog signal from an amplified system, digitally stored information (e.g., such as on a hard drive), a digital input jack, USB, fiberoptic, or wireless. Input sources may also be provided via a human interface. For example, the input source may be a light effects control board (i.e. theatrical digital light board equipment), web browser, or generic sensors (e.g., proximity sensors).

An input stream may include digital packets of information from one or more devices connected to a computer network. An input stream can also include digital information from one or more peripheral devices connected to a computer. The input stream may include a digital output signal from a software application. The input stream may also include digital information, coming from one or more human interface devices designed for live performances. The input stream may also come from one or more electronic sensors.

The signal analyzer may include an algorithm that may create changing visual patterns in real-time based on perceptual aspects of the input stream, such as music. The signal analyzer may receive the input signal and provide an output signal, which may be a visualization signal representing perceptual aspects of music, in real-time. The signal analyzer may derive one or multiple types of data from the input stream, may generate one or multiple visualization elements that are related to the one or multiple types of data, and combine these visualization elements into a single visualization output stream. Alternatively, they may be combined into multiple visualization output streams.

In some embodiments, the signal analyzer may derive several digital streams representing visualizations of several perceptual elements in the input stream (such as an audio or music input), and may adjust the amplitude of one or more digital visualization streams to form adjusted visualization streams. The signal analyzer may adjust other characteristics of a digital visualization stream, such as delay, decay, baseline, or shape. Alternatively, the signal analyzer need not make such an adjustment. In some embodiments, the signal analyzer may determine whether such adjustment is desired for each digital visualization stream. The adjusted visualization streams and/or unadjusted digital visualization streams may be combined into a single combined visualization output stream or multiple combined visualization output streams. The signal analyzer will be discussed in greater detail below.

A communication system or component may utilize any communication hardware or configuration. For example, a communication channel may be wired or wireless. In some embodiments a digital signal or an analog signal may be provided. A communication system may utilize serial and/or parallel connections. Some example of connections may include USB, RS-232, or DMX.

Valves 2 and 9 may modulate the flow rate of fuel, such as flammable gas from gas source 13 to the burners 6 and 10. Fuel may flow along one or more flow paths. Fuel may preferably include a fluid, such as a liquid or gaseous fuel. For instance, fuel may be a flammable gas. Any other apparatus or mechanism for modulating the flow of gas from a gas source may be provided. In some embodiments, a plurality of variable valves may control fuel flow rate in a plurality of flow paths. For example, as discussed previously, the valves may be variable gas valves, such as a proportional solenoid valve. Valves may utilize any electromechanical actuator, such as an electric motor or solenoid, pneumatic actuators, which may be controlled by air pressure, or hydraulic actuators which may be controlled by liquid pressure. For example, electromechanical actuators may modulate variable valves. Some examples of actuators which may be integrated with variable valves may include a proportional solenoid, shape memory alloy (e.g., "muscle-wire"), piezo actuator, piezo linear motor, or an electromagnetic linear motor.

Any modulators for the variable valves may be provided, wherein the modulators are configured to modulate said variable valves at a desired rate, which may be at a sufficiently fast rate to capture perceptual elements of music as it plays. In some embodiments, modulators may be configured to modulate variable valves at least several times per second. For example, such modulation may be possible approximately 100 times per second, 50 times per second, 25 times per second, 20 times per second, 15 times per second, 10 times per second, 8 times per second, 5 times per second, 4 times per second, 3 times per second, 2 times per second, 1 time per second, once every 2 seconds, once every 3 seconds, once every 5 seconds, or once every 10 seconds. In some implementations, modulators may operate at a frequency falling within 0.1 Hz to 100 Hz, or any value greater than 0.1 Hz. Modulators may operate based on a visualization signal provided by the signal analyzer. Such modulators may operate in real-time based on an ongoing visualization signal provided by the signal analyzer.

Any valve control means may be used. In some instances, a variable power source may be provided. This may utilize a pulse width modulator (PWM), a switching regulator, a linear regulator, any combination thereof.

The modulation or control of the fuel flow to a burner may affect the characteristic of the flame provided at the burner. In some embodiments, the same fuel type may be provided to all of the burners. Alternatively, different fuels may be provided to different burners. In some embodiments, different fuels may be provided to the same burner. The system may control which fuel is provided to a burner, or whether a combination of fuel is provided to a burner. The use of different fuels may affect the flame characteristics at a burner. For example, the amount of fuel, or characteristics of fuel provided to a burner may affect flame characteristics such as size, shape, duration, or color.

As the modulators for the valves may be controlled in real-time, thus the flames provided by the various burners may be controlled in real-time. The presence or characteristics of flames at the burners may be provided in reliance on an ongoing input stream. The flames may be controlled as the input is provided. Thus, the flames may be varied or maintained based on the input stream, before the input stream is completed.

Ignition system 4 may light the flame at burner 6 when necessary or desired, and likewise, ignition system 12 may light the flame at burner 10 when necessary or desired. The ignitions systems may receive independent on/off signals. Alternatively, they may receive coordinated on/off signals. Possible ignition techniques are discussed in greater detail below. In some embodiments, one ignition system may be provided per burner. In other embodiments, one ignition system may be provided for multiple burners, or multiple ignition systems may be provided per burner. In some instances, a plurality of ignition systems may be provided for a plurality of burners, and a relationship may be provided such that an ignition system may light a flame at a designated burner or set of burners, or for any of the burners. Sometimes additional ignition systems may be provided as a backup.

Some examples of ignition systems may include a spark ignition system, a hot surface igniter, pilot light, or any combination thereof. The same ignition systems may be provided for each of the burners, or the ignition systems may vary between burners. Any of the ignition systems within the system may be the same or may vary.

A flame detection system 3 may detect the presence of a flame at burner 6, and may close valve 2 when ignition failure occurs. Likewise, another flame detection system 11 may detect flame at burner 10 and may close valve 9 when ignition failure occurs. Similarly, one flame detection system may be provided per burner. Alternatively, one flame detection system maybe provided for multiple burners, or multiple flame detection systems may be provided per burner. In some instances, a plurality of flame detection systems may be provided for a plurality of burners, and a relationship may be provided such that a flame detection system may detect flame at a designated burner or set of burners, or at any of the burners. Sometimes additional flame detection systems may be provided as a backup. Similarly, any number of flame detection systems may be provided for any number of valves. For example, one flame detection system may close one or more valves when ignition failure occurs, or one or more flame detections may be provided and capable of closing a particular valve when ignition failure occurs. In some embodiments, the flame detection system may close all valves associated with one or more burners where ignition failure is detected to have occurred.

A flame detection system may utilize various components or techniques to detect flames. The flame detection system may be used to detect the presence or absence of flames. The flame detection system may also be used to measure the magnitude, temperature, or other characteristics associated with a flame. Any flame detection sensors or techniques may be used to make such measurements. The flame detection system may detect or include flame rectification, flame resistance, thermocouple, thermopile, or any combination thereof.

A first flame element 7 may include a first variable valve 2 and a first burner 6, and a second flame element 8 may include a second variable valve 9 and a second burner 10. In some embodiments, the first flame element may also include a first flame detection system 3 and/or a first ignition system 4, and the second flame element may include a second flame detection system 11 and/or a second ignition system 12. In some embodiments, each flame element may include a valve and a burner. The flame element may also include the modulator for the valve. Any number of flame elements may be provided for a fire display. For example, one or more, two or more, three or more, four or more, five or more, six or more, seven or more, eight or more, ten or more, fifteen or more, twenty or more, thirty or more, fifty or more, seventy five or more, or a hundred or more flame elements may be provided. In some instances, multiple flame elements may be in communication with a single signal analyzer. Alternatively, a single flame element may be in communication with a single signal analyzer, multiple signal analyzers may be in communication with a single flame element, or multiple flame elements may be in communication with multiple signal analyzers.

Figure 2:
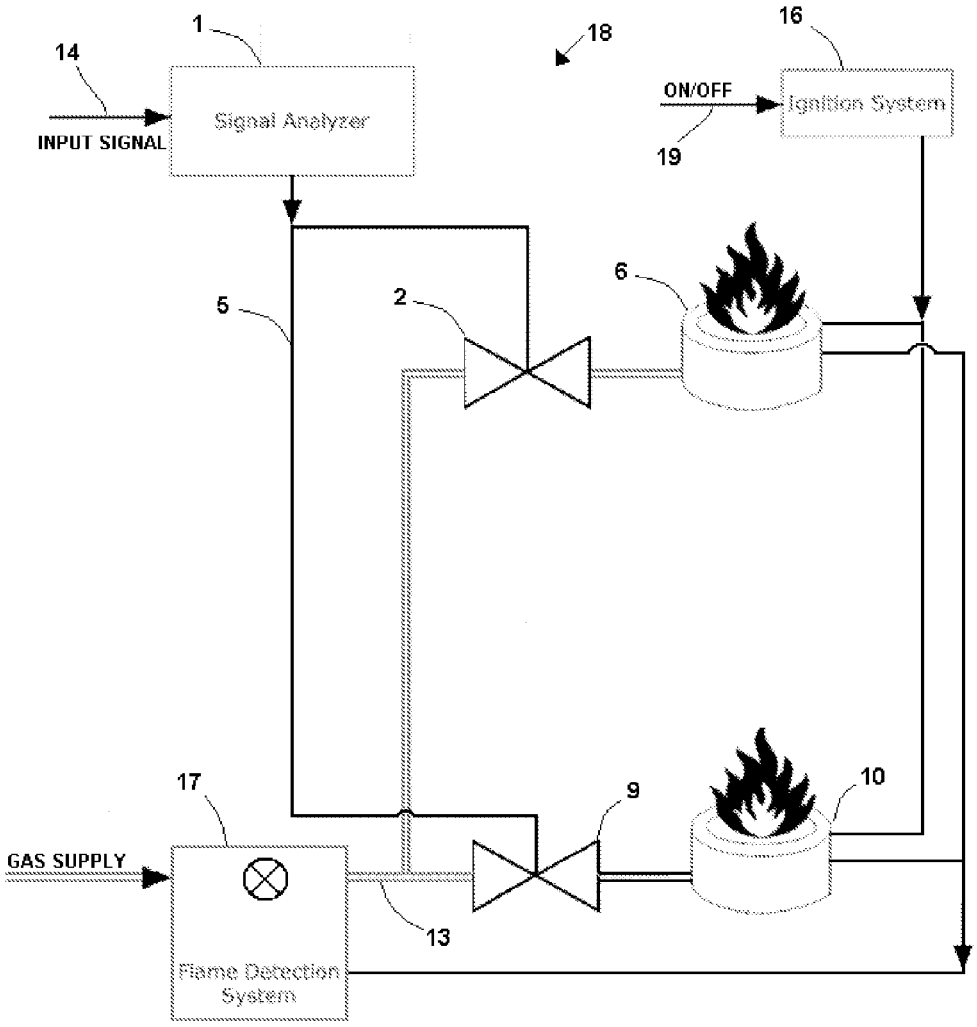
FIG. 2 is a schematic diagram of an alternative embodiment of a music-reactive fire display showing principle elements in an alternative arrangement.

FIG. 2 is a schematic diagram of a fire display 18, similar to the previously described fire display 15, but representing a different arrangement of the components of the system. An input signal 14 may be provided to a signal analyzer 1 which may provide a visualization signal via a communication channel to variable valves 2, 9. The signal analyzer may convert the electronic input stream into the visualization signal in real-time. The variable valves may be connected to burners 6, and may control the fuel flow rate thereto. A difference here is that both burners 6 and 10 may share a single ignition system 16 and/or flame detection system 17. Gas or any other fuel may be supplied to the flame detection system, which may provide a source 13 of the fuel to the valves. As discussed previously, various arrangements of ignition and flame detection systems may be provided.

The ignition system 16 may receive an independent on/off signal 19, which could come from a user or another device that turns the fire display system on and off. In some embodiments, an on/off signal that may be provided by a user or another device may also interact with a gas supply and/or input signal. For example, in some embodiments, an on/off signal may affect whether the entire fire display is on or off, while in other embodiments, the on/off signal may only control the ignition system, or other components of the fire display.

Upon receiving an "on" signal, the ignition system 16 may ignite both burners 6 and 10. The flame detection system 17 may monitor the flame on both burners and terminate the gas supply 13 if an ignition failure is detected. This system could be built using a hot-surface igniter with a pilot light as the ignition system, and a thermocouple and a millivolt valve as the flame detection system. These are standard components on gas furnaces. Any other ignition systems or flame detection systems as are known in the art may be used.

Figure 3:
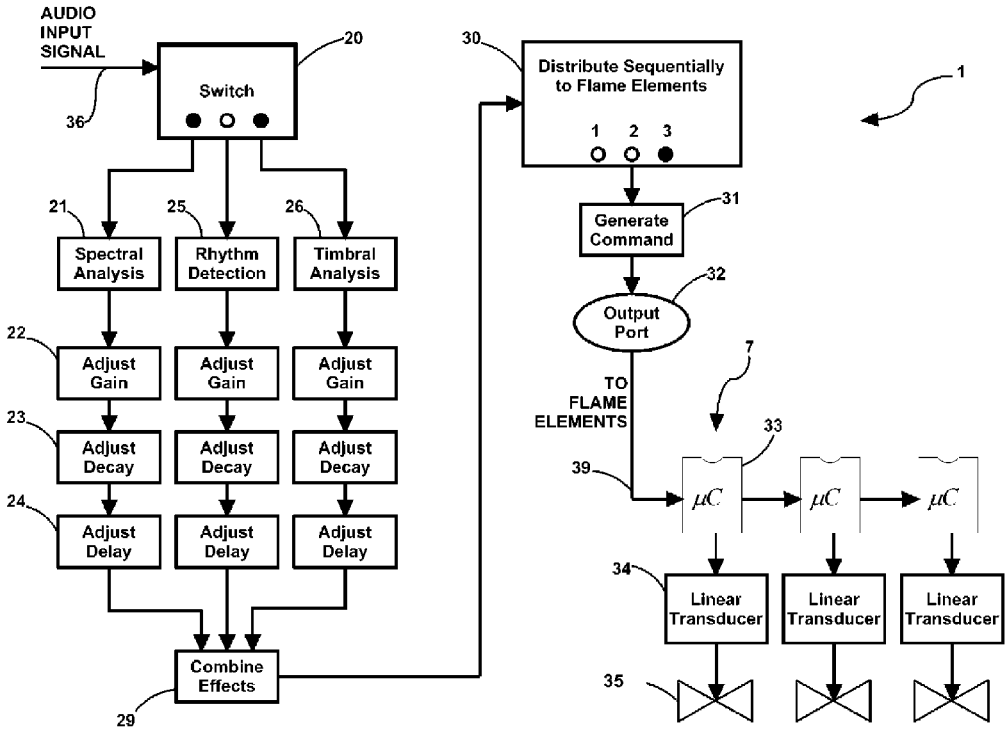
FIG. 3 is a block diagram of a preferable embodiment of a signal analyzer.

The signal analyzer in a preferable embodiment may be a computer, which can run software that is outlined in the block diagram of FIG. 3. Any discussion herein of a signal analyzer or computer may also apply to any type of computing device, including but not limited to a personal computer, server computer, or laptop computer; personal digital assistants (PDAs) such as a Palm-based device or Windows CE device; phones such as cellular phones; mobile devices, such as smartphones such as iPhones, Blackberries, etc.; a wireless device or other device comprising a processor or capable of performing as discussed herein. Any discussion hereon of computers or any of the devices, may apply to any other of the devices. The signal analyzer may utilize an algorithm which may be provided on a device, or distributed over multiple devices. A computer may have computer readable media, which may contain instructions, logic, data, or code that may be stored in persistent or temporary memory of the computer, or may somehow affect or initiate action by a computer. Any computer readable media with logic, code, data, instructions, may be used to implement any software, algorithms, steps, or methodology.

Preferably, an audio input signal 36 may enter first a switch 20 that may select at least one of several algorithms to be performed on the input signal. In one embodiment, spectral analysis 21, rhythm detection 25, and timbral analysis 26 may be performed on an audio input signal. These algorithms can convert audio data into representative flame-intensity data. For example, spectral analysis may be used to generate a graphical equalizer effect. Other algorithms that may analyze an audio input signal may be used, which may include algorithms relating to volume, harmonics, pitch, or any other acoustical quality.

In some embodiments, a spectrum analyzer (a.k.a., graphical equalizer) may be incorporated by the signal analyzer. Frequency bins from a Fast Fourier Transform (FFT) with a filter M(f) may be utilized. The signal analyzer may also look at instrumental notes from an audio stream. This may include fundamental frequencies of several harmonic series, and may utilize an autocorrelation algorithm to find the most probable groups of multiple series. Instrumental notes analysis may also utilize frequency domain zooming based on "active" portions of the signal spectrum. Timbral analysis may incorporate spectral distributions of harmonic partials, by examining the centroid of spectral distribution, the regularity of distribution (how closely peak frequencies match theoretical partial frequencies), and the shape of distribution (do the peaks drop off smoothly, towards higher frequencies or are there dips/gaps). The timbral analysis may also examine time-variance of spectral distributions of harmonic partials, i.e. how does the spectral distribution evolve during the "attack" phase. A signal analyzer may also look at tempo estimation. This may include inter-onset time interval grouping. Such analysis may occur by selecting valid onsets, and ranking reliability of groupings—e.g., fuzzy logic in matrix format. Superposition of several algorithm outputs at adjustable gains may be combined to form a combined flame-intensity data stream.

Thus a music reactive fire display may include a signal analyzer that incorporates at least one routine to estimate the tempo of music, and impart the visualization signal with at least one aspect associated with the estimated tempo. The music reactive fire display may also include a signal analyzer that incorporates at least one routine that generates data based on the instrumental notes in the music, and imparts the visualization signal with at least one aspect associated with the instrumental note information. The music reactive fire display may also include a signal analyzer that incorporates at least one routine that samples the audio signal at measured time intervals and performs a FFT on the samples in order to impart the visualization signal with at least one aspect associated with the FFT result. The music reactive fire display may include a signal analyzer which generates a graphical equalizer effect in the flame output from the audio signal.

Alternatively, the input signal may be digital, representing encoded information from another computer, peripheral, or network device. The signal analyzer would then decode this information and perform transformations of the relevant data into streaming visualization data. These transformations could generate timed sequences of flame events, or be real-time reactions to streaming network input. As a further alternative, the input signal may be an analog or digital signal output from one or several sensors. In this case, the signal analyzer may use analog or digital means to transform the input data to an output stream.

In a preferable embodiment, the gain, decay and delay of each algorithm output may then be adjusted. It may be determined whether the gain, decay, and/or delay need to be adjusted to fall within a desired range, and if so, such adjustments may be made. The gain adjusters 22 may apply a multiplier to change the intensity of the output. In some instances, the intensity of the output may fall within a designated range. The decay adjusters 23 may control the rate at which the intensity of the flame is allowed to change. The delay adjusters, 24 may insert a time delay between the audio signal and the output signal. After passing through the adjusters, the signals corresponding to specific algorithms may be combined 29. In some embodiments, the signals may be combined into a single visualization output. Alternatively, they may be combined into multiple visualization outputs.

The combined flame-intensity data may then pass through a switch 30 that may sequentially refresh each flame element with a new flame-intensity setting. In some alternate embodiments, each flame element may be refreshed in parallel or simultaneously. The data for individual flame elements (e.g., 7) may then be packaged as commands according to protocol in a command generator 31 and sent to the serial port of the computer 32. The computer may communicate via a communications channel 39 with the flame elements. The flame elements may be provided along the communications channel in series, in parallel, or in any combination thereof. Thus, the flame elements may receive instructions in sequence, simultaneously, or in any combination. In some embodiments, the signal analyzer may provide instructions to a first microcontroller, which may send instructions to the second microcontroller, and the second microcontroller may send instructions to a third microcontroller, and so on. A microcontroller 33 at each flame element may interpret the serial commands, and modulate the variable valve 35 for that flame element via a linear transducer 34.

Figure 4:
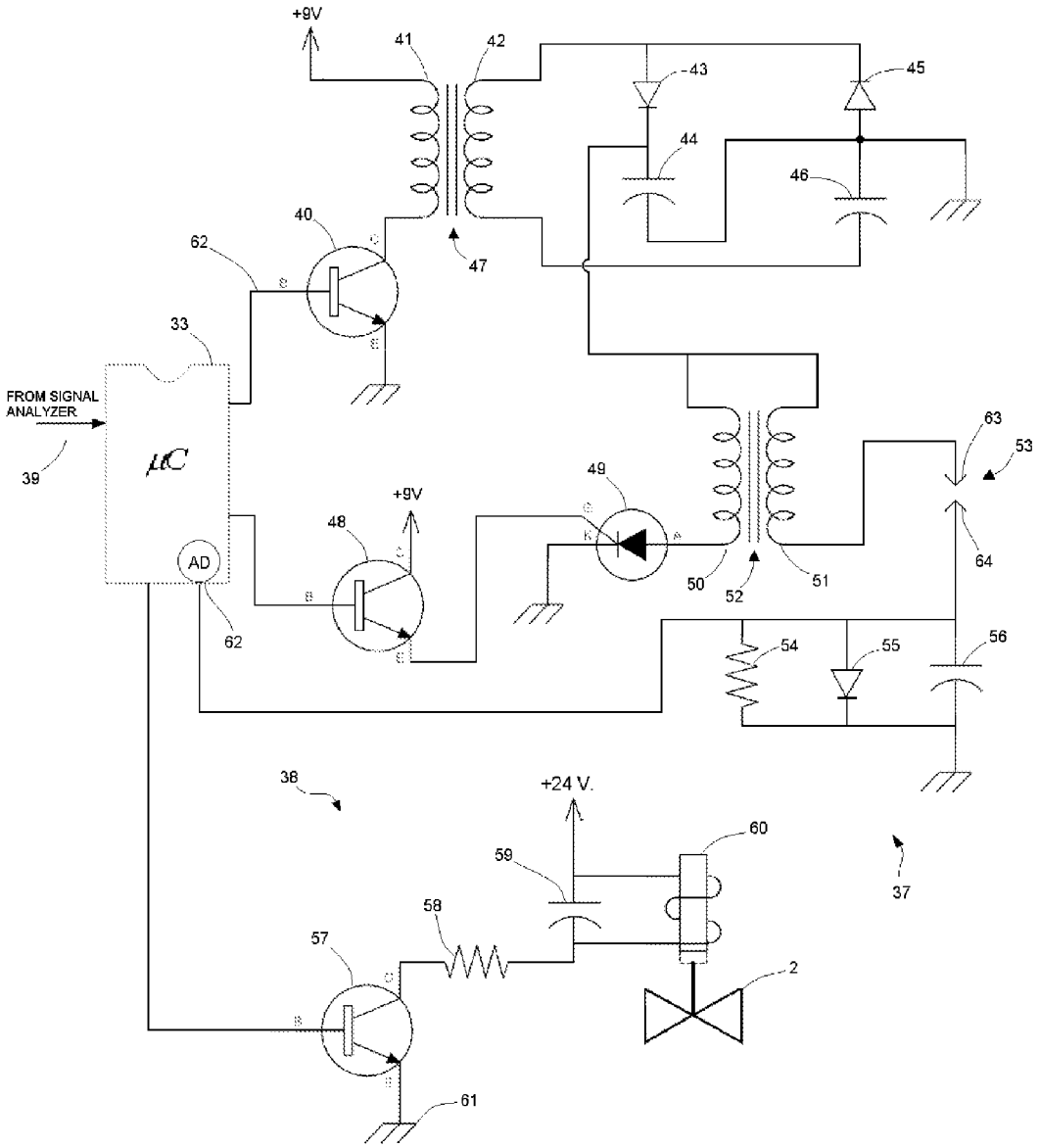
FIG. 4 is a schematic circuit diagram of a preferable embodiment of an ignition system, flame detection system, and variable valve control in a preferable arrangement.

FIG. 4 is a schematic circuit diagram of the combined ignition and flame detection systems 37 and the linear transducer 38, which may be part of the communication system with the variable valve 2. A microcontroller 33 may receive a signal 39 from a signal analyzer. To ignite the burner, the microcontroller 33 may send a pulsating signal 62 to the base pin of bipolar transistor 40. Transistor 40 may drive the primary winding 41 of transformer 47, which can create a high voltage oscillating waveform on the secondary winding 42. The secondary winding 42 may be connected through diodes 43 and 45 to capacitors 44 and 46, which may be arranged to form a voltage doubler. This effectively allows the peak-to-peak voltage, e.g. 500V, generated at 42 to accumulate in capacitor 44 when a pulsating waveform is applied by the microcontroller 33 to the base of transistor 40. In a preferable embodiment, the peak-to-peak voltage may be about 500 V, while in other embodiments, the peak-to-peak voltage may be any voltage suitable for charging a capacitor to a sufficient energy for creating a combustion-inducing spark. For example, the voltage may be about 300 V or more, 400 V or more, 450 V or more, 550 V or more, 600 V or more, 800 V or more, or any voltage falling within 50-1000 V.

Capacitor 44 may be connected to one end of the primary 50 winding of transformer 52. The other end of primary winding 50 is connected through a SCR 49 to ground. The gate of the SCR 49 may be controlled by the microcontroller 33, through transistor 48. When the microcontroller raises the voltage to the base of transistor 48, the SCR 49 may discharge capacitor 44, which may be at 500V, through the primary winding 50. This may generate a very high voltage, (e.g., 10 kV, 15 kV, 20 kV, 30 kV, 50 kV) across the secondary winding 51, which may result in a spark at the igniter 53.

Flame detection may be achieved by applying the available high-voltage at capacitor 44 across the sparking terminals 63, 64 of the igniter without triggering the SCR 49. When a flame is present in the gap between sparking terminals 63, 64, the voltage on terminal 63 can create a current from 63 to 64, which can be detected by microcontroller 33. This may be done by connecting capacitor 44 to one end of the secondary winding 51 of the high-voltage transformer 52. The other end of the secondary winding 51 is connected to igniter terminal 63, so when the primary winding 50 is not energized, the voltage on terminal 63 is equal to the voltage at capacitor 44. The other terminal 64 of the igniter 53 may be connected to ground through a resistor 54, a diode 55, and a capacitor 56 in parallel. As current passes through the resistor to ground when a flame is present, the voltage across the resistor may be detected by the analog to digital converter (ADC) 62 on the microcontroller. The diode 55 and the capacitor 56 may serve to protect the microcontroller from damage during sparking by limiting the transient voltage at 64 to levels that will not damage the microcontroller. In order to determine if a flame is present, capacitor 44 may preferably be charged by energizing transformer 47.

In a single flame element 7, the linear transducer 34 that allows the microcontroller 33 to drive the variable valve 2 may be accomplished as follows. An output pin of the microcontroller 33 is connected to the base of transistor 57. The emitter of transistor 57 is grounded at 61, and the collector is connected to one end of the solenoid coil 60 through a low-pass filter comprised of resistor 58 and capacitor 59. The other end of the solenoid coil is connected to a positive dc voltage source, e.g. 24V. With this circuit, the microcontroller can apply a PWM signal to the base of transistor 57 to modulate the power delivered to the solenoid coil 60, and thus control the flow of gas through valve 2.

Figure 5:
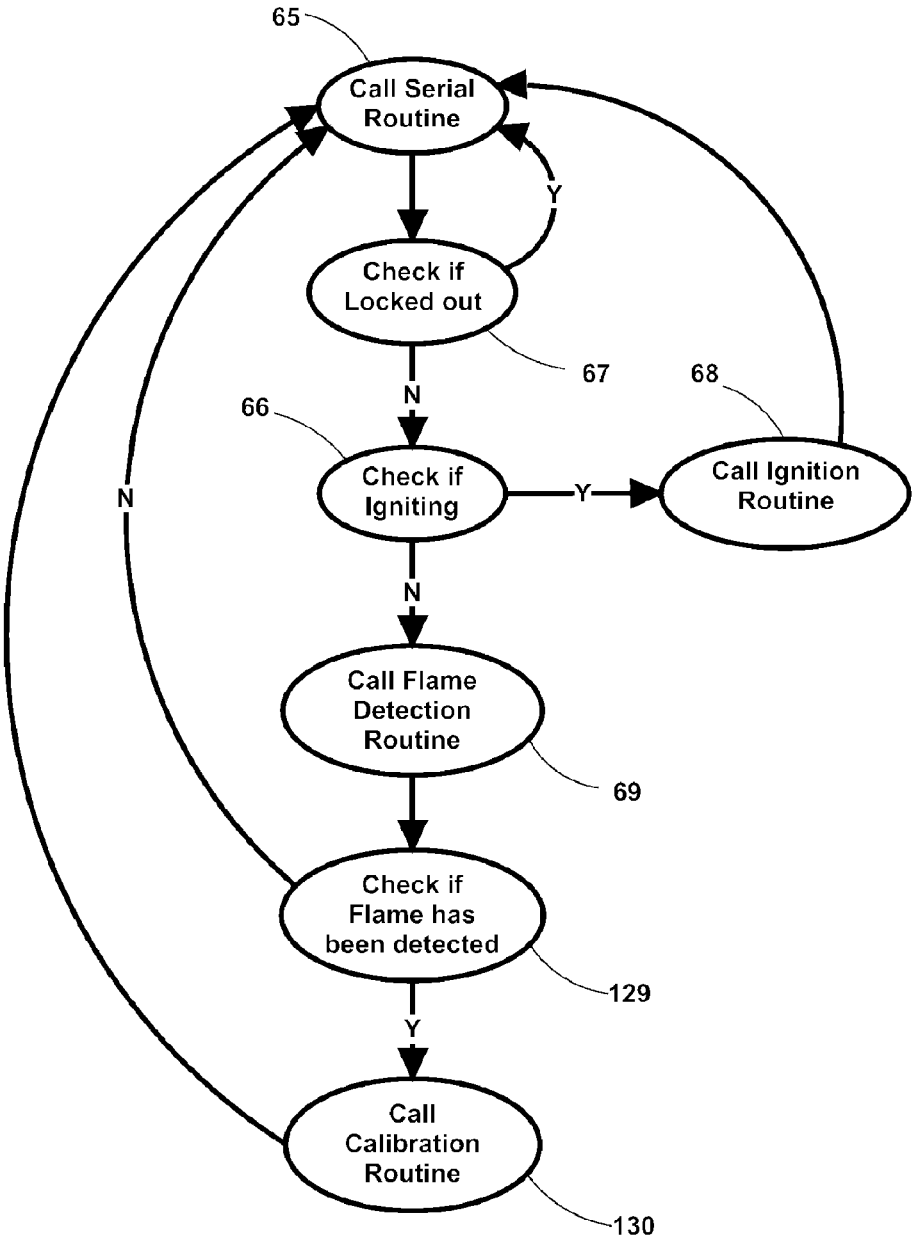
FIG. 5 is a block diagram of a main program loop which a microcontroller may execute in a preferable embodiment to control the ignition, flame detection and valve systems.

FIG. 5 depicts, in a block diagram, a main program loop that a microcontroller in each flame element may execute to control an ignition system, flame detection system and variable valve. The microcontroller may be directly or indirectly in communication with one or more signal analyzer, and may receive an input. The input may be in digital or analog form. In some embodiments, the input may be in bytes received.

In each program cycle, the program may first call its serial communication routine 65 to check for bytes received or to send queued data. Next, the program may check if a lockout bit is set 67. If the lockout bit is set, the program may return to the start, thus bypassing any flame-related functionality, but still allowing communication. If the lockout bit is not set, the program may check if an ignition cycle is underway 66. If the ignition cycle is underway, the program may call an ignition subroutine 68. Otherwise the program may run the flame detection subroutines 69. This sequence may prevent the program from attempting to detect flame while the ignition is happening. This may be desirable or necessary when the same circuit is used for both operations.

After running the flame detection subroutines, the program may optionally check if a flame has been detected 129. If it has not, the program may return to the start, bypassing any calibration. If a flame has been detected, the program may call a calibration subroutine 130. Calibration will be discussed in greater detail below. In some embodiments, any of these steps may be optional or may be provided in various orders. Similarly, equivalent or similar steps may be provided in the place of any of these steps.

Figure 6:
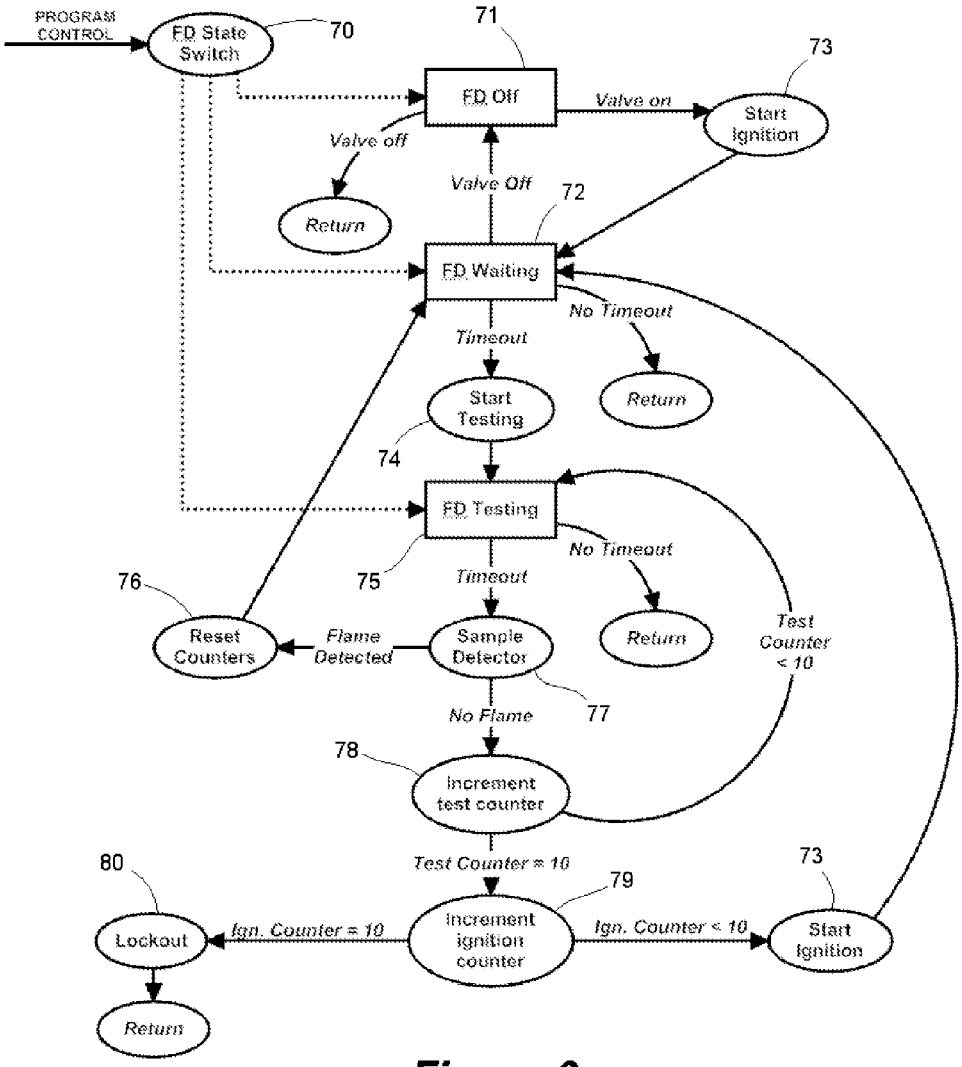
FIG. 6 is a block diagram of flame detection logic that a microcontroller may execute to operate the flame detection unit in a preferable embodiment.

FIG. 6 shows a block diagram of a flame-detection routine, which may be part of the microcontroller's program. Upon calling the flame detection routine, program control may first go to the state switch 70, which may direct execution to the appropriate location in the program based on the value of a flame detection state variable. In some implementations, there may be three possible states: "off" 71, "waiting" 72, and "testing" 75.

In the "off" state 71, the program may check if the valve-open variable is zero, indicating the valve is closed. If it is, the routine returns. The routine may return to a main program loop, such as the one discussed previously. If the valve-open variable is greater than zero, an ignition routine may be called 73, followed by a change in state to "waiting" 72.

The "waiting" state 72 may have two exit conditions: either a set amount of time passes since entering the "waiting" state, or the valve closes fully. If neither of these conditions have been met, the process may return with no action. If the valve is closed, the state changes to "off" 71. If the set delay elapses, the program may start testing 74, and may enter the "testing" state.

Upon entering the testing state 75, the microcontroller may begin sending a pulsed signal to the ignition system charger 62 in order to generate a high voltage, but not a spark, across the igniter leads. The program will return from the "testing" state with no action until a set delay has elapsed since entering the "testing" state. When the delay elapses, the processor may sample the ADC 77 to detect the presence of a flame. The ADC reading may be compared with a threshold value; if the reading is greater than the threshold, the microcontroller records that a flame is present. If the flame is present, a test counter variable may be reset 76. Otherwise, the microcontroller records an absence of flame.

If a flame is not detected the processor increments the test counter variable 78, which may count the number of consecutive negative readings. If the test counter variable is less than a set maximum number, (e.g. five, ten, fifteen, or any other number) the program may remain in the "testing" state to sample the ADC again, and resets the delay timer. If the test counter value equals the maximum number, the processor may increment an ignition counter variable 79, which may count the number of consecutive failed ignition attempts. If the ignition counter value is less than a set maximum number, (e.g. five, ten, fifteen, or any other number) the processor may call the ignition routine 73 and change state to "waiting." If the ignition counter value equals the maximum number the program may enter lockout state 80; a lockout message may be queued for transmission, a lockout bit may be set, and the flame detection routine returns.

If a flame is detected, the processor may reset both the ignition counter variable and test counter variable to zero 76, and enter the "waiting" state to begin the process again after a set time delay in the waiting state.

In some instances, if a program enters a lockout state, this may be indicative that a failure to ignite may be occurring. This may lead to turning off a gas supply, so that in the event of failure to ignite, flammable gas will not accumulate and cause a hazardous condition.

The flame detection routine may store the result of the ADC reading in a globally accessible variable, or it may return the value as an output argument to the main program loop for later use by a calibration subroutine or compensation system. A compensation system may reduce imprecision of a fuel flow rate.

Figure 10:
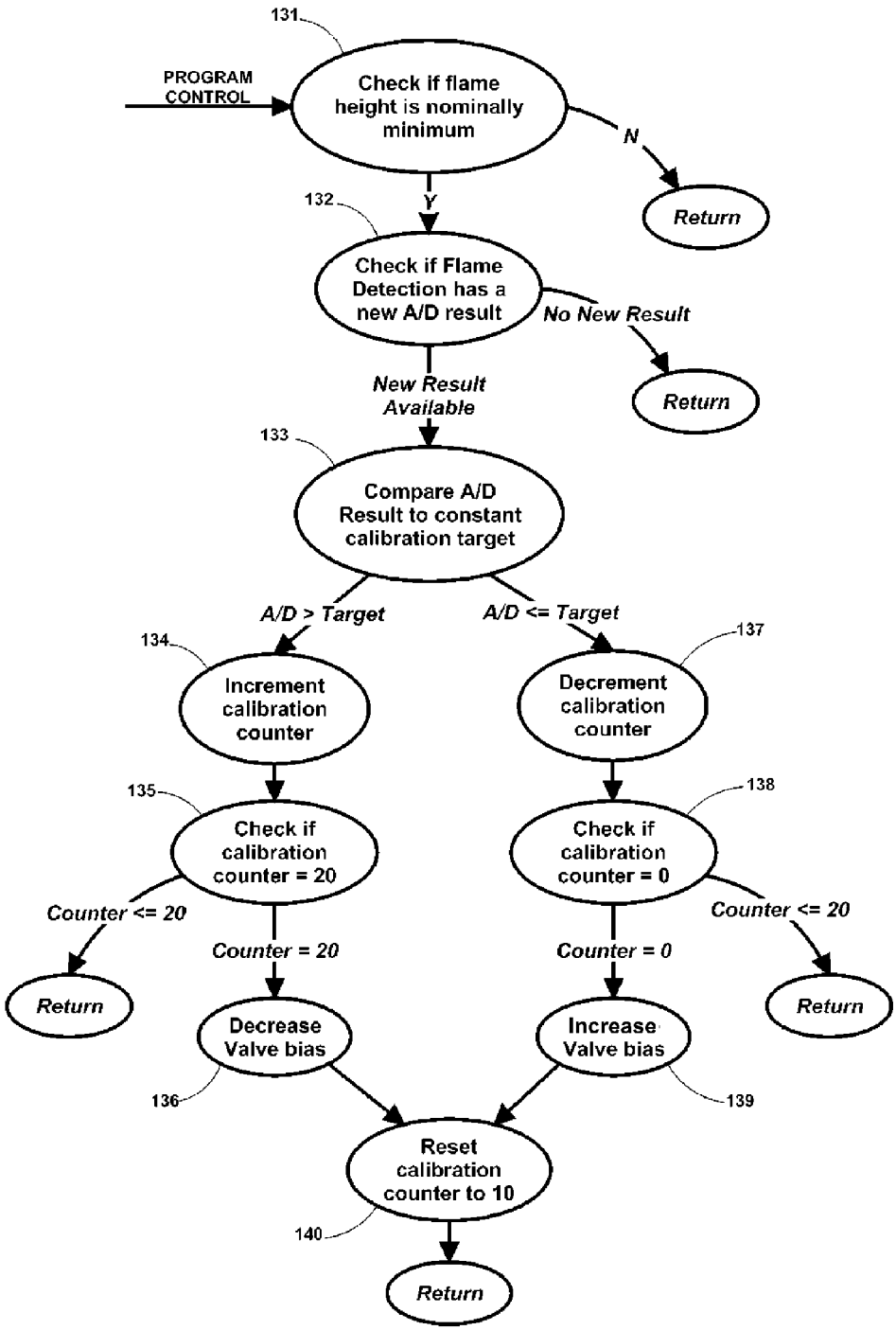
FIG. 10 is a block diagram of a calibration routine that a microcontroller may execute to compensate for variations in the fuel flow rate.

FIG. 10 shows a block diagram of a calibration routine that may adjust the control signal to the variable valve 2 to compensate for variations in flow rate through the valve. This preferably may be done by adjusting a bias voltage to the valve 2 that is just sufficient to sustain a flame. Upon entering the calibration routine, the program may check if the smallest stable flame is desired 131, as communicated by the signal analyzer. If the nominal flame size is not the smallest stable flame, the routine returns. Otherwise, if the signal analyzer has requested the smallest stable flame, the calibration routine may proceed. In some alternate embodiments, the calibration routine may proceed when a small stable flame, or flame size falling within a particular range, or any flame size, has been requested.

The program may then check if a new result from the flame detection ADC is available 132. If no new result is available, the subroutine returns. If a new result is available, this new result is used to determine if the flame is larger than the desired smallest stable flame.

The program may compare the ADC result with a constant number or value representing the calibration target 133. In some embodiments, the calibration target may be fixed. In other embodiments, it may be varied (e.g., by user input or automatically depending on an application). An ADC result that is greater than the target indicates a flame that is larger than desired, a "high" reading. Conversely an ADC result that is smaller than the target indicates a flame that is smaller than desired, a "low" reading. A counter is used to keep track of the number of "high" readings minus the number of "low" readings 134, 137. If the flame is too large, more "high" readings will be recorded than "low" readings, and the counter will increase in value. If the flame is too small, more "low" readings will be recorded, and the counter will decrease in value. The program may check the counter each time it changes 135, 138 and if the counter is between an upper and lower boundary, e.g. 20 and 0, the calibration routine returns. The boundaries may be fixed, or may be varied (e.g., by user input or automatically depending on an application).

If the counter reaches the upper boundary, the bias voltage sent to the valve may be decreased 136 to decrease the size of the flame at the minimum setting. If the counter reaches the lower boundary, the bias voltage may be increased 139. After either increasing or decreasing the bias, the program may reset the counter to a value between the boundary values 140 and then return. The use of a counter makes the calibration routine less susceptible to noise and short-term variations in the flame detection signal, improving the stability of the calibration system.

Many other techniques for compensating for variations in fuel flow rate may be employed without departing from the present invention. In one alternate embodiment, a valve with passive thermal compensation may be used. For example, the compensation system may counteract thermal drift caused by material properties that vary with changing temperature of the variable valves. In another embodiment, a separate flow rate sensor may be used, and a feedback loop established with the valve-control circuitry. In another embodiment, the valve control circuitry may provide a constant current to a solenoid valve that is independent of the resistance of the solenoid winding to compensate for thermal drift. In another embodiment, the behavior of the valve could be characterized with respect to hysteresis, and software may be used to predictively counteract the hysteresis of the valve. In further embodiments, the valves, valve control circuitry or software may be calibrated at a factory.

A compensation system may perform a calibration routine using flame detection hardware, a flow-rate measuring device, and/or using direct compensation for specific error sources. Some examples of such direct compensation may include thermal compensation using elastomeric properties of sealing surfaces. In some embodiments, the compensation may actively adjust the input to a modulator (such as an electromagnetic actuator) to achieve a desired fuel flow rate based on a flow-rate reference. The flow-rate reference may be derived using flame detection hardware and circuitry. The compensation system may also passively counteract one or more sources of imprecision in the fuel flow rate. The compensation system may include one or more passive components that may be adjusted and set at a factory to calibrate part of the system to achieve a desired fuel flow rate.

Figure 7:
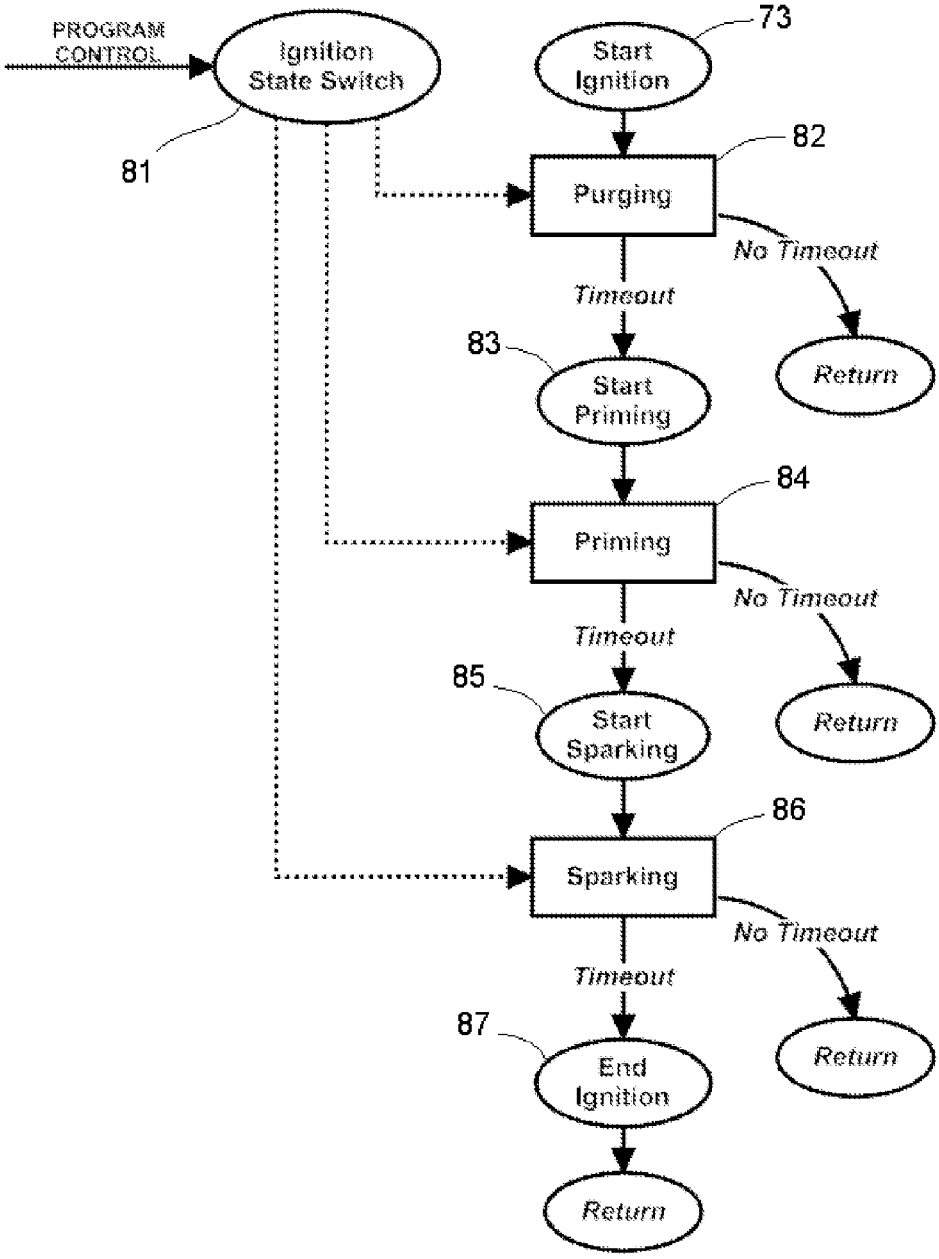
FIG. 7 is a block diagram of an ignition sequence that a microcontroller may execute to ignite the flame in a preferable embodiment.

FIG. 7 shows a block diagram of an ignition sequence that may reliably ignite the flame with the disclosed technology. When the ignition sequence is started by a call to 73, the program may enter a "purging" state 82. Thereafter, the main program loop may call the ignition state switch 81 with each cycle. The ignition state switch may direct execution to the location in the program corresponding to the current ignition state. In some implementations, there may be three ignition states, "purging" 82, "priming" 84, and "sparking" 86.

On entering the purging state 82, the program may call a subroutine 73, which begins applying a pulsating signal to 62 to energize the sparking circuit, and also opens the variable valve to a high initial setting, e.g. 75% of maximum aperture, to purge the system of air. Purging 82 may continue for a specified period of time, e.g., 10 milliseconds (ms), during which time the program returns without action from the purging state. In some implementations, sensors may be provided to determine if purging is complete.

When purging time has elapsed, the program may enter the priming state 84 via subroutine 83, which may reduce the valve aperture to a low-flow setting, e.g. 5%, but continues energizing the spark circuit. Priming may continue for a specified period of time, e.g. 20 ms, 40 ms, 60 ms, 100 ms or more.

When priming time has elapsed, the program may enter the sparking state 86 via subroutine 85, which may trigger the SCR 49 to generate a momentary spark in the igniter 53 to ignite the flame. Sparking may continue for a specified period of time, e.g. 4 ms or any other length of time, during which the SCR continues to be triggered, the ignition systems remains energized, and the valve remains at the low-flow setting (5%). After the time (e.g. 4 ms) has elapsed, the program may end the ignition sequence 87, which may cease to energize the spark circuit with the pulsed waveform on 62, stop triggering the SCR, and indicate to the main control loop that the ignition sequence is no longer in progress.

Figure 8:
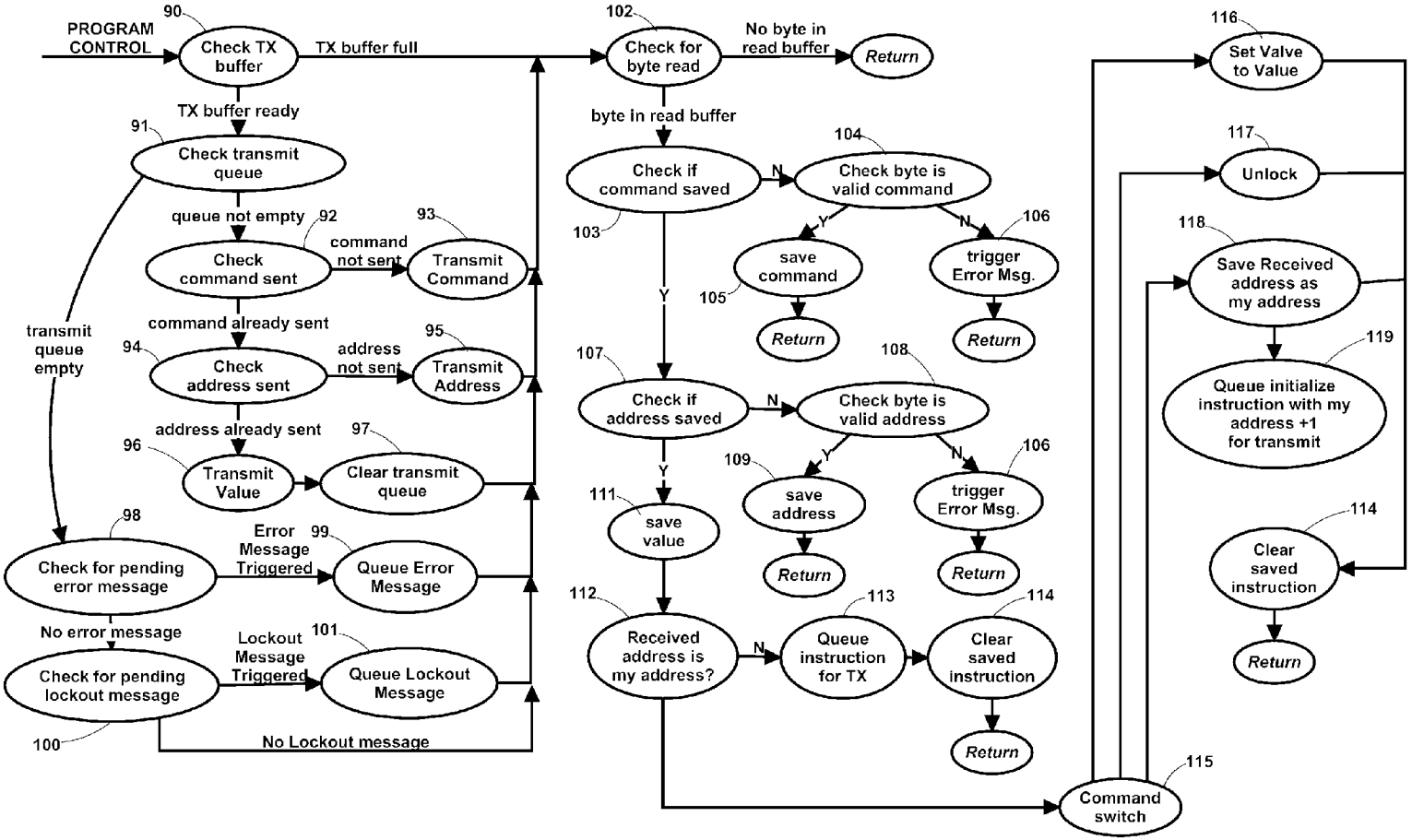
FIG. 8 is a block diagram of the protocol that the signal analyzer and microcontrollers may use to communicate with each other.

FIG. 8 shows a block diagram representing a section of a microcontroller program that manages serial communication. Serial communication in this embodiment may be facilitated by microcontrollers each equipped with a Universal Asynchronous Receiver Transmitter (UART). As depicted in FIG. 3, in some embodiments, the signal analyzer may send commands directly to the microcontroller on the first flame element only. The first microcontroller then passes commands to the second, and so-on from microcontroller to microcontroller. The microcontrollers may have sequential addresses that are used to direct commands to individual flame elements, which they receive from their upstream neighbor during an initialization command. In alternate embodiments, the signal analyzer may send commands directly to one or more microcontroller, or series of microcontrollers, or microcontrollers arranged in parallel, or microcontrollers arranged in any combination thereof.

The microcontrollers and the signal analyzer may use a 3-byte protocol to convey information. The first byte is a command that specifies the action to be performed. The second byte is an address that specifies which element should perform the action. The third byte is a value that is sometimes utilized, but must always be present for a complete instruction.

Control may first be passed to a transmit section of the program 88. The microcontroller may check the status of the transmit buffer 90 to see if a byte can be sent. If the transmit buffer is full, execution may jump to a receive section of the program 89. If the transmit buffer is ready to transmit a byte, the microcontroller may check if a command is still being sent from the transmit queue 91. The transmit queue may hold one 3-byte instruction for transmission. If data remains in the transmit queue, the microcontroller checks first the command 92, and then the address 94 bytes of the queue to determine which byte is next in-line. The microcontroller sends the next-in-line byte to the transmit buffer 93, 95 or 96. If the value, which is the last byte in an instruction, was sent, the transmit queue is cleared 97. If the transmit queue from check 91 is empty, the microcontroller checks first an error message flag 98 and then a lockout message flag 100. If either are set, the appropriate instructions, which are informative only, are loaded into the transmit queue 99 and 101. Following either transmitting a byte, or queuing a message, execution moves to the receive section of the program 89.

In the receive section 89, the microcontroller checks if a new byte is ready in the read buffer 102. If no new bytes are ready, the routine returns. If a new byte is ready, the microcontroller checks if a command has already been received 103. If a command has not been received yet, the new byte is verified as a valid command 104. If the byte is a valid command, the byte is saved as the command of the current instruction 105 and the routine returns. If the byte is not a valid command, the error flag is set, which will cause an error message to be sent, and the routine returns. The byte is not saved.

If a new byte is ready and a command has been received, the microcontroller checks if an address has already been received also 107. If not, the new byte is verified as a valid address 108. If it is a valid address, the byte is saved as the address of the current instruction 109. If the byte is not a valid address, an error message is sent 106 and the routine returns without saving the byte. The valid range for a command and an address preferably would not overlap so that a command can not be mistaken for an address and vice-versa. This allows the microcontroller to recover quickly if it receives an incorrect sequence of bytes.

If an address has been received, the new byte is saved as the value of the current instruction 111. Next, the microcontroller checks if the address of the current instruction matches its own saved address 112. If not, the new instruction is queued for transmission to the next flame element 113 and the instruction is cleared from memory 114 to make way for a new instruction and the routine returns.

If the address of the new instruction matches this element's address, the command switch 115 executes the appropriate command according to the command byte. For one value of the command, the microcontroller applies the value field of the current instruction to the proportional valve 116 through the linear transducer. A larger number in the value field corresponds to a larger valve aperture. For another value of the command, the microcontroller will return from the lockout condition 117 by clearing the lockout bit. For a third value of the command, the microcontroller will initialize its own address to equal the value in the current instruction 118 and then pass along that the initialization instruction, incrementing the value 119 to give the next element an address of one greater than its own address. This initialization process allows neighboring flame elements to store sequential addresses. Each of these operations, 116, 117, 118-119 then clears the saved instruction to accept a new instruction, and then returns from the routine.

Many more commands can be supported by this protocol and program with simple adaptations. This subset of possible commands is a subset of commands that may be used to control the fire display 15.

Figure 9:
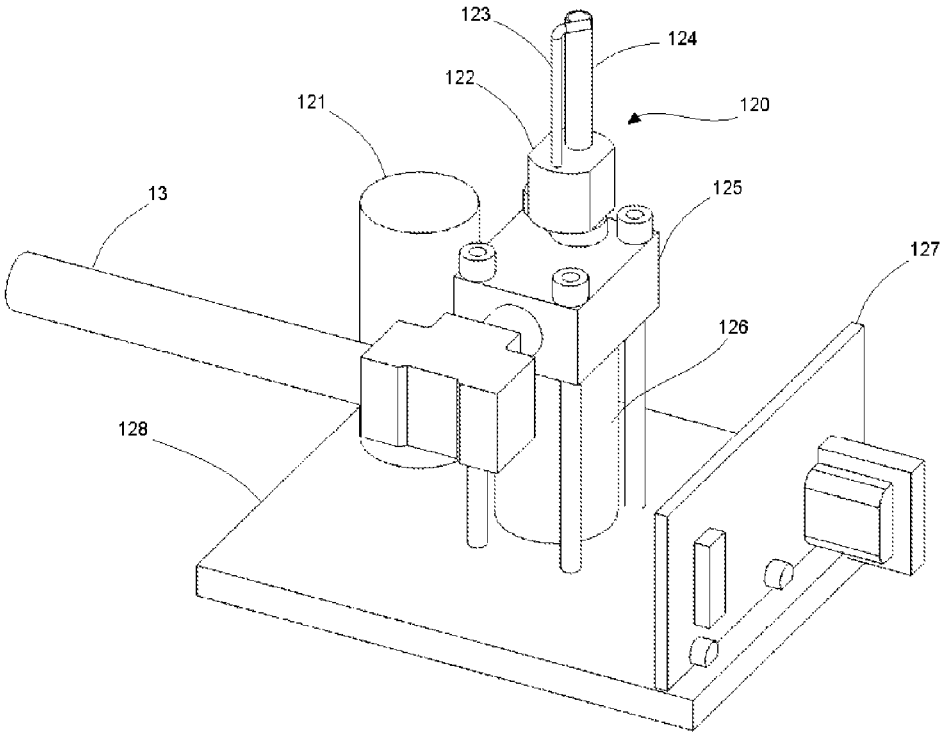
FIG. 9 is a mechanical diagram of a single flame element in a preferable embodiment.

FIG. 9 is a mechanical diagram of a preferable construction of one flame element. The base 128, and manifold 125 may be constructed of aluminum, or some elemental metal or combination thereof (e.g., steel, titanium, silver, palladium, brass, copper, iron), or a plastic, composite material, or some other suitably strong material. The gas supply 13 may convey flammable gas, e.g. propane, to the manifold 125 with standard pipe-thread hardware. The proportional valve, 126 controls the flow rate of gas through the manifold 125 and into the burner 120. The burner 120 may be constructed of a plastic insulator 122, an igniter lead 123, and a metal tube 124, which serves the dual purpose of being the second igniter lead and a conveyor of flammable gas. Various materials with desired physical and/or thermal properties may be used for these burner components. The spark may jump between the igniter lead and the tube where the flammable gas first mixes with air. The high voltage coil 121 may be spaced some distance (e.g., several inches) away from the printed circuit board (PCB) 127 to avoid magnetic or electric interference. The ground of the PCB is connected to the base 128 to better shield the electronics. Although not shown in FIG. 9, the coil 121 may be connected to the PCB 127 and the igniter leads 123, 124, and the PCB may be connected to the PV 126 according to the circuit diagram in FIG. 4, or any other circuit configuration that may provide similar functions.

In some embodiments, pressurization elements may be utilized by the system. For example, a hermetically sealed piston-electric motor compressor may be used for said pressurization. Pressurizing the fuel may provide a shorter delay between electronic input to the PV and visual appearance of a change in the flame size, or this may allow the use of smaller, potentially less expensive variable valves. An adapted refrigerator compressor may be incorporated.

The invention, when constructed according to the provided description, may be preferably used in the following way. The computer running signal analyzer software may read a musical audio data stream from its hard-drive. Alternatively, the audio data stream may be any other type of audio data stream (e.g., talking, environmental sounds, any other sounds). In alternative embodiments, an input stream, other than audio, may be provided on a computer hard-drive, or may be stored in the computer's temporary memory, or may be provided streaming or in real time from another source. In some embodiments, the system may be able to capture live or recorded music. The system may or may not incorporate microphones or similar audio capturing devices.

Audio data may be sent, via the computer's sound card, to speakers that play the music. At the same time, the computer may process audio data and send a stream of instructions to a bank of flame elements, which may be connected to each other in series (or in any other arrangement) and to a power supply. The flame elements may automatically ignite themselves, and begin responding to instructions from the computer.

The desired visual effect is that the fire aesthetically dances to the music. The flames within the fire display may be varied or maintained in order to correspond to perceptual characteristics of the music. For example, the magnitude of a flame may correspond to the volume of the music (e.g., loud music may result in larger flames). In some embodiments, certain burners may be related to certain pitch ranges of the music (e.g., some burners may be devoted to higher pitched notes while other burners may be devoted to lower pitched notes). The size, shape, direction, color, duration of the flame may be varied based on characteristics of the input stream.

In some implementations, the fire display system may be provided for a fireplace, such as a home fireplace. A fireplace may be provided indoors or outdoors. Alternatively, smaller or larger-scale fire displays may be provided. For example, the fire display may be part of a staged performance or some other sort of entertainment. The fire display may be incorporated into an architectural structure, or may be sculptural. The fire display may be installed indoors or outdoors.

The fire display system may have any configuration. In some embodiments, multiple independent burners may be provided. Each burner may have one input. In some embodiments, many burners may be utilized. In some implementations, a single burner may have multiple gas (or other fuel) inputs. For example, a linear burner with many orifices and different amounts of gas coming out of different parts of the burner may be used. Another example may be a parallel vertical plate burner. A moving burner head may be used, which may produce different flame trajectories. The burners may be incorporated into a large-scale structure, such as a two-dimensional grid.

Here, the circuit that controls the flame elements may be implemented with a microcontroller, a spark igniter and a conductivity-based flame detector built into every flame element. However, the control system shown here could be implemented without microcontrollers, using electromechanical components or different electronic components.

While the invention has been described here with reference to one preferred embodiment, the invention is not limited to this precise embodiment. Many modifications and variations will be apparent to a person skilled in the art without departing from the scope of this invention.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A music-reactive fire display that creates visual patterns of fire in response to perceptual aspects of music in real-time comprising:

a signal analyzer that converts an audio signal representing music into a visualization signal representing perceptual aspects of the music in real-time, and a plurality of variable valves controlling fuel flow rate in a plurality of flow paths leading to one or more discrete flame elements;

modulators for said variable valves, wherein said modulators are capable of modulating said variable valves at a sufficiently fast rate of at least 2 times per second utilizing pressurization fuel supply lines to convey pressurized fuel within the plurality of flow paths leading to the one or more discrete flame elements which capture perceptual aspects of the music in the visual patterns of fire as it plays, the visual patterns including a variation in flame height among the one or more discrete flame elements;

a communication system between the signal analyzer and the discrete flame elements, wherein multiple discrete flame elements are in communication with the signal analyzer, and wherein said discrete flame elements operate based on said visualization signal conveyed by said communication system to provide the visual patterns of fire in response to the perceptual aspects of the music in real-time reliance of the audio signal; and a compensation system wherein the compensation system actively adjusts input to the modulators to independently control a desired fuel flow rate in the plurality of flow paths leading to the one or more discrete flame elements based on flame detection hardware and the visualization signal to continuously provide sufficient flame height to maintain flame under variable indoor and outdoor conditions that could otherwise disrupt the visual patterns of the music-reactive fire display.

2. The music reactive fire display of claim 1, further comprising:

an automatic ignition system for igniting the fire, wherein the variable valves control variation in the fuel flow rate to permit ignition under variable indoor and outdoor conditions.

3. The music reactive fire display of claim 2 wherein the automatic ignition system includes electrodes for igniting the fire, wherein the same electrodes are used to detect the presence or absence of a flame.

4. The music reactive fire display of claim 1, wherein the flame detection hardware measures the intensity of the fire.

5. The music reactive fire display of claim 1, further comprising: a plurality of burners, wherein the fuel flow rate to each burner is modulated by one of the variable valves.

6. The music reactive fire display of claim 5 wherein the signal analyzer generates a graphical equalizer effect in the flame output from the audio signal.

7. The music reactive fire display of claim 1 wherein the music reactive fire display is provided as part of a live performance.

8. The music reactive fire display of claim 1 wherein the music reactive fire display is installed outdoors.

9. The music reactive fire display of claim 1 wherein the signal analyzer incorporates at least one routine to estimate the tempo of the music, and imparts the visualization signal with at least one aspect associated with the estimated tempo.

10. The music reactive fire display of claim 1 wherein the signal analyzer incorporates at least one routine that generates data based on the instrumental notes in the music, and imparts the visualization signal with at least one aspect associated with the instrumental note information.

11. The music reactive fire display of claim 1 wherein the signal analyzer incorporates at least one routine that samples the audio signal at measured time intervals and performs a Fast Fourier Transform on the samples in order to impart the visualization signal with at least one aspect associated with the Fast Fourier Transform result.

12. The music reactive fire display of claim 1 wherein the signal analyzer derives multiple types of data from the audio stream, generates multiple visualization elements that are related to said multiple types of data, and combines these visualization elements into a single visualization output stream.

13. The music reactive fire display of claim 1 wherein a single ignition system, a flame detection system, a variable valve, and a modulator for controlling a variable valve are grouped into a flame element device of the one or more discrete flame elements, and wherein a plurality of flame element devices are in communication with a single signal analyzer.

14. The music reactive fire display of claim 13 wherein the single signal analyzer uses a serial protocol to communicate with the plurality of flame elements which are connected in series, wherein only one flame element of said plurality receives a command directly from the signal analyzer, and the one flame element transmits the command it received to another flame element.

15. The music reactive fire display of claim 14 wherein the plurality of flame elements have different addresses, and the serial protocol permits only a flame element with an address specified by the command to execute the command.

16. The music reactive fire display of claim 13 wherein the number of flame elements can be varied upon installation.

17. The music reactive fire display of claim 1 wherein the variable valves are proportional solenoid valves that are modulated by varying a current supplied to a solenoid coil of the solenoid valve.

18. The music reactive fire display of claim 1 wherein the audio signal representing music is provided by one or more of the following: analog signal from an amplified system, digital recording, or computer.

19. The music reactive fire display of claim 1 wherein said modulators operate before input of the audio signal is completed.

20. A digitally controlled fire display that produces changing patterns of flame in response to a digital input stream comprising:

multiple variable valves controlling fuel flow rate in multiple flow paths leading to one or more discrete flame elements;

electromechanical actuators that modulate the variable valves wherein the electromechanical actuators are capable of modulating said variable valves at the sufficiently fast rate of at least 2 times per second utilizing pressurization fuel supply lines to convey pressurized fuel within the plurality of flow paths leading to the one or more discrete flame elements;

a signal analyzer that converts the digital input signal into a visualization signal in real-time;

a communication system between the signal analyzer and the electromechanical actuators that causes the electromechanical actuators to modulate the variable valves to produce changing patterns of flame including a variation in flame height among the one or more discrete flame elements in real-time based on said visualization signal in real-time reliance of the digital input stream; and a compensation system that reduces imprecision in the fuel flow rate, wherein the compensation system actively adjusts input to the electromechanical actuator to independently control a desired fuel flow rate in the plurality of flow paths leading to the one or more discrete flame elements based on flame detection hardware and the visualization signal to continuously provide sufficient flame height to maintain flame under variable indoor and outdoor conditions that could otherwise disrupt the visual patterns of the digitally controlled fire display.

21. The digitally controlled fire display of claim 20, wherein the flame detection hardware determines one or more of the following characteristics associated with the fire: magnitude of the fire, electrical conductivity of the fire, or temperature of the fire, and wherein the desired fuel flow rate achieved maintains flame of a desired magnitude in various indoor and outdoor conditions.

22. The digitally controlled fire display of claim 20, wherein the compensation system passively counteracts one or more sources of imprecision in the fuel flow rate, wherein the compensation system uses one or more passive compensation components that are configurable.

23. The digitally controlled fire display of claim 22, wherein the compensation system comprises one or more passive components that are adjusted and set at a factory to calibrate part of the system to achieve a desired fuel flow rate.

24. The digitally controlled fire display of claim 20, wherein the compensation system counteracts thermal drift caused by material properties that vary with changing temperature of the variable valves.

25. The digitally controlled fire display of claim 20, wherein the compensation system predictively counteracts one or more sources of imprecision in the fuel flow rate.

26. The digitally controlled fire display of claim 20 wherein the adjustment to the input to the electromechanical actuator by the compensation system includes an adjustment of a bias voltage to a proportional solenoid valve.

27. The digitally controlled fire display of claim 20 wherein the compensation system provides a current to a proportional solenoid valve that is independent of the resistance of a solenoid winding to compensate for thermal drift.

28. The digitally controlled fire display of claim 20 wherein compensation system further includes a filter to handle transient signals.

29. The digitally controlled fire display of claim 20 wherein each discrete flame element includes a compensation system comprising digital programming that continuously adjusts a bias voltage applied to the electromechanical actuators in response to flame intensity readings from the flame detection hardware in order to maintain a stable minimum flame when the signal analyzer commands the flame element to produce the smallest possible flame under variable indoor or outdoor conditions.

30. The digitally controlled fire display of claim 29 wherein the compensation system comprises one or more programmable settings that are adjusted and set at a factory to calibrate part of the compensation system to achieve a consistent fuel flow rate across multiple discrete flame elements when the multiple discrete flame elements receive the same visualization signals under the same conditions.

31. A digitally-controlled fire display that produces changing patterns of flame in response to an electronic input stream comprising:

a signal analyzer that converts the electronic input stream into a visualization signal in real-time;

a plurality of variable valves controlling gas flow rate in a plurality of flow paths leading to one or more discrete flame elements;

a plurality of electromechanical actuators that are capable of modulating the variable valves at a rate of at least 2 times per second utilizing pressurization fuel supply lines to convey pressurized fuel within the plurality of flow paths leading to the one or more discrete flame elements to provide a variation in flame height among the one or more discrete flame elements in response to the visualization signal in real-time reliance of the electronic input stream; and a communication system between the signal analyzer and the electromechanical actuators; and a compensation system wherein the compensation system actively adjusts input to the electromechanical actuators to independently control a desired fuel flow rate in the plurality of flow paths leading to the one or more discrete flame elements based on flame detection hardware and the visualization signal to continuously provide sufficient flame height to maintain flame under variable indoor and outdoor conditions that could otherwise disrupt the visual patterns of the digitally-controlled fire display.

32. The digitally controlled fire display of claim 31, wherein the input stream includes digital packets of information from one or more devices connected to a computer network.

33. The digitally controlled fire display of claim 31, wherein the input stream includes digital information from one or more peripheral devices connected to a computer.

34. The digitally controlled fire display of claim 31, wherein the input stream includes a digital output signal from a software application.

35. The digitally controlled fire display of claim 31, wherein the input stream includes digital information, coming from one or more human interface devices designed for live performances.

36. The digitally controlled fire display of claim 35, wherein the human interface devices include at least an item of theatrical digital light board equipment.

37. The digitally controlled fire display of claim 31, wherein the input stream comes from one or more electronic sensors.

38. A method of controlling fire to produce visual effects in flames comprising:

conveying a digitized audio stream representing music to a signal analyzer;

deriving, using said signal analyzer, several digital streams representing visualizations of several perceptual elements in the audio stream;

adjusting the amplitudes of at least one of said digital visualization streams at the signal analyzer to form adjusted flame intensity data, wherein said adjustment is determined by the signal analyzer to form the desired visual effects in the flames;

combining said digital and/or adjusted flame intensity data into a single combined visualization output stream;

modulating a plurality of variable gas valves at a sufficiently fast rate of at least 2 times per second that control the flow of gaseous fuel in a plurality of flow paths leading to one or more discrete flame elements utilizing pressurization fuel supply lines to convey pressurized fuel within the plurality of flow paths leading to the one or more discrete flame elements in response to the combined visualization output stream and on flame detection hardware, thereby reducing imprecision in the fuel flow rate, wherein said modulation occurs in real-time reliance of the digitized audio stream, and wherein said modulation continuously provides sufficient flame height to maintain flame under variable indoor and outdoor conditions that could otherwise disrupt the visual effects in the flames; and conveying the gaseous fuel modulated by the variable valves to a plurality of burners to produce flames that vary in height in reliance to the music represented by the digitized audio stream.

39. The method of claim 38 wherein the height of the flames produced by the burners correlate to volume of the music.

* * * * *